US005307116A

United States Patent [19]

Ikunami et al.

[11] Patent Number: 5,307,116

[45] Date of Patent: Apr. 26, 1994

[54] IMAGE FORMING APPARATUS PROVIDED WITH UNIT LOCKING MEANS

[75] Inventors: Yoshikazu Ikunami; Susumu Okui; Kazunobu Miura; Takao Shiozawa; Hiroaki Ura; Masaru Ushio, all of Hachioji, Japan

[73] Assignee: Konica Corporation, Tokyo, Japan

[21] Appl. No.: 94,617

[22] Filed: Jul. 19, 1993

[30] Foreign Application Priority Data

Aug. 11, 1992 [JP] Japan ..... 4-214217
Oct. 22, 1992 [JP] Japan ..... 4-284478

[51] Int. Cl.[5] ..... G03G 21/00

[52] U.S. Cl. ..... 355/207; 271/9; 271/263; 271/273; 355/282; 355/309; 355/316

[58] Field of Search ..... 355/72, 200, 202, 203, 355/207, 208, 210, 282, 285, 290, 308, 309, 316, 321; 219/216; 271/8.1, 9, 263, 273, 274

[56] References Cited

U.S. PATENT DOCUMENTS 4,531,823 7/1985 Deguchi et al. ..... 355/308
4,958,823 9/1990 Iwaki et al. ..... 271/9
5,049,945 9/1991 Kukano et al. ..... 355/290
5,065,180 11/1991 Shindo et al. ..... 355/72
5,134,443 7/1992 Sumi et al. ..... 355/309
5,157,448 10/1992 Lang ..... 355/309

*Primary Examiner*—R. L. Moses
*Assistant Examiner*—William J. Royer
*Attorney, Agent, or Firm*—Frishauf, Holtz, Goodman & Woodward

[57] ABSTRACT

An image forming apparatus such as a copier or a printer for forming an image of a document on a recording paper. The image forming apparatus includes a paper feed tray for holding the recording paper; a conveyance unit for conveying the recording paper from the paper feed tray; a image forming section for forming a toner image of the document onto the recording paper; a fixing unit for fixing the toner image on the recording paper; a detector for detecting a paper jam between the units, and for generating a detection signal; a locking member with a solenoid for locking one of the units in another; a controller for controlling the locking member according to the detection signal so that both of the units are resisted from being removed separately when the paper jam occurs between the units.

9 Claims, 8 Drawing Sheets

IMAGE FORMING APPARATUS PROVIDED WITH UNIT LOCKING MEANS

BACKGROUND OF THE INVENTION

The present invention relates to a jam clearance and unit pullout means effectively used when a jam that occurs, for example, between a paper conveyance unit and a paper feed tray unit provided in an image forming apparatus such as a copier and an image scanner.

In general, an electrophotographic image forming apparatus such as a copier and an image scanner comprises: a platen on which a document is set; an optical scanning system including a document illuminating lamp and a reflecting mirror, which are reciprocated under the platen, and also including a projection lens and a reflecting mirror, which are fixed; a rotational photoreceptor drum that is charged to a predetermined potential by a charging electrode; a developing unit that develops an electrostatic latent image formed on the photoreceptor drum, with toner; a transfer electrode that transfers the formed toner image onto a recording paper, which is a transfer sheet, conveyed toward the photoreceptor drum; a separation electrode; a discharge electrode; a fixing unit to fix the toner image transferred onto the recording paper surface; and a cleaning unit to remove residual toner and dust on the photoreceptor drum surface.

Predetermined toner images are successively recorded on the recording papers intermittently conveyed in a predetermined conveyance passage.

In the apparatus described above, the paper feed conveyance unit, fixing unit including a paper discharge roller and a plurality of paper feed tray units are constructed so that they can be respectively pulled out from the image forming apparatus. For example, when a paper jam occurs in the paper feed conveyance unit, the unit is pulled out for jam clearance, that is, the jammed recording paper is removed.

However, for example, in the case where a conveyed recording paper is jammed between the paper feed conveyance unit and the paper feed tray unit, the jammed recording paper is damaged when one of the units is carelessly pulled out. To remove the damaged recording paper from one of the units costs much labor. When the jam clearance operation is not performed completely, the successive recording papers are also jammed.

In the case where the image forming apparatus is constructed so that each unit can be pulled out, the following problems may be encountered: In the case where a plurality of units are carelessly pulled out at the same time, the balance of the apparatus is lost so that the apparatus falls down. Further, when the apparatus is designed, dead spaces are unnecessarily formed, so that the apparatus can not be made compact. Even when the units are overlapped so as to make the apparatus compact, there is a possibility that the photoreceptor drum or another unit is damaged when each unit is not pulled out in a predetermined order.

The present invention is to overcome the above disadvantages. It is an object of the present invention to provide an image forming apparatus characterized in that: even when a recording paper is jammed between two units, it can be easily, positively and quickly removed without being damaged; and when the units are pulled out for jam clearance, there is no possibility that the balance of the apparatus is lost, and that the units are pulled out in wrong order thereby affecting other units.

SUMMARY OF THE INVENTION

The object of the present invention can be accomplished by one of the following embodiments (a), (b) and (c).

(a) An image forming apparatus includes plural paper feed units, a paper feed conveyance unit and a fixing unit, the units forming a transfer sheet conveyance passage, each unit being capable of independently being pulled out. In the image forming apparatus, an engagement means provided in each unit is controlled by a detection means to detect a jammed paper position, when a transfer paper is jammed between at least two units, so that each unit can not be pulled out; and after jam clearance, each unit is set to be pulled out.

(b) An image forming apparatus includes plural paper feed units, a paper feed conveyance unit and a fixing unit, said units forming a transfer sheet conveyance passage, each unit being capable of independently being pulled out. In the image forming apparatus, an engagement means provided in each unit is controlled by a detection means to detect a unit pulled out, when at least one unit is pulled out, so that other units can not be pulled out.

(c) An image forming apparatus includes plural paper feed units, a paper feed conveyance unit and a fixing unit, said units forming a transfer sheet conveyance passage, each unit being capable of independently being pulled out. In the image forming apparatus, an engagement means provided in each unit is controlled by a detection means to detect a unit pulled out, in wrong order that is against a predetermined order, so that the unit can not be pulled out in the wrong order.

DETAILED DESCRIPTION OF THE INVENTION

Figure 1:
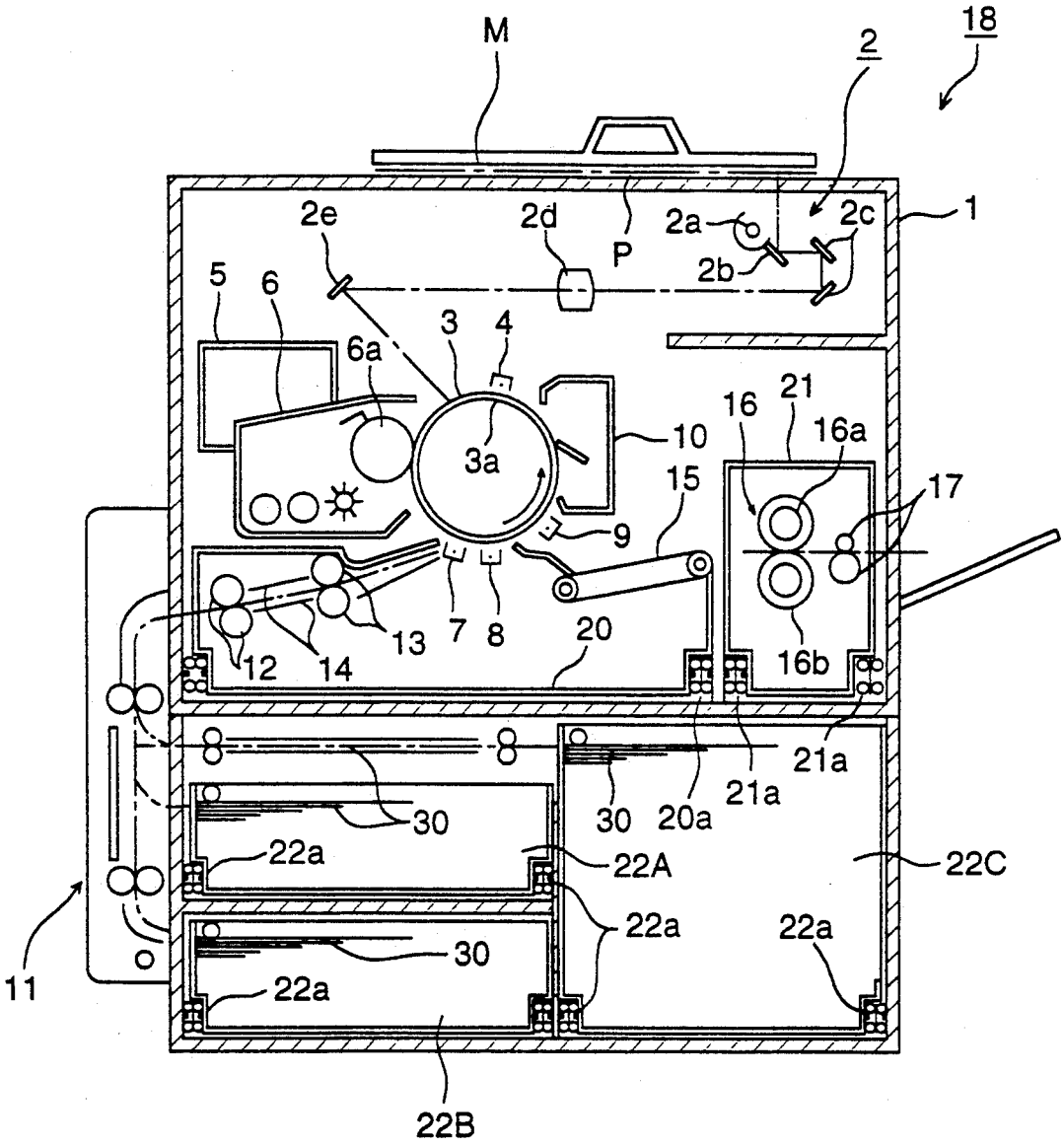
FIG. 1 is a sectional side view showing the structure of an image forming apparatus.
Figure 2:
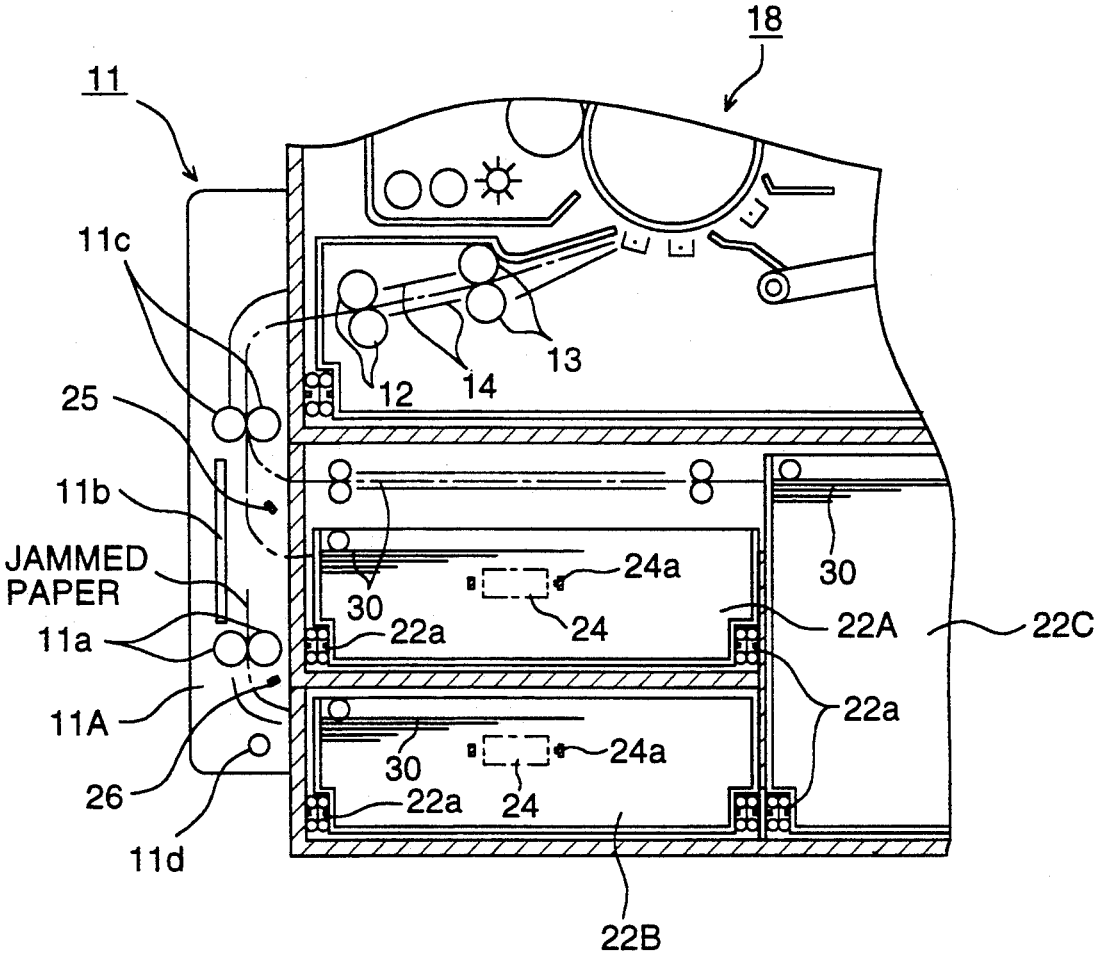
FIG. 2 is a sectional side view showing the structure of a paper feed tray unit and a conveyance section.
Figure 3:
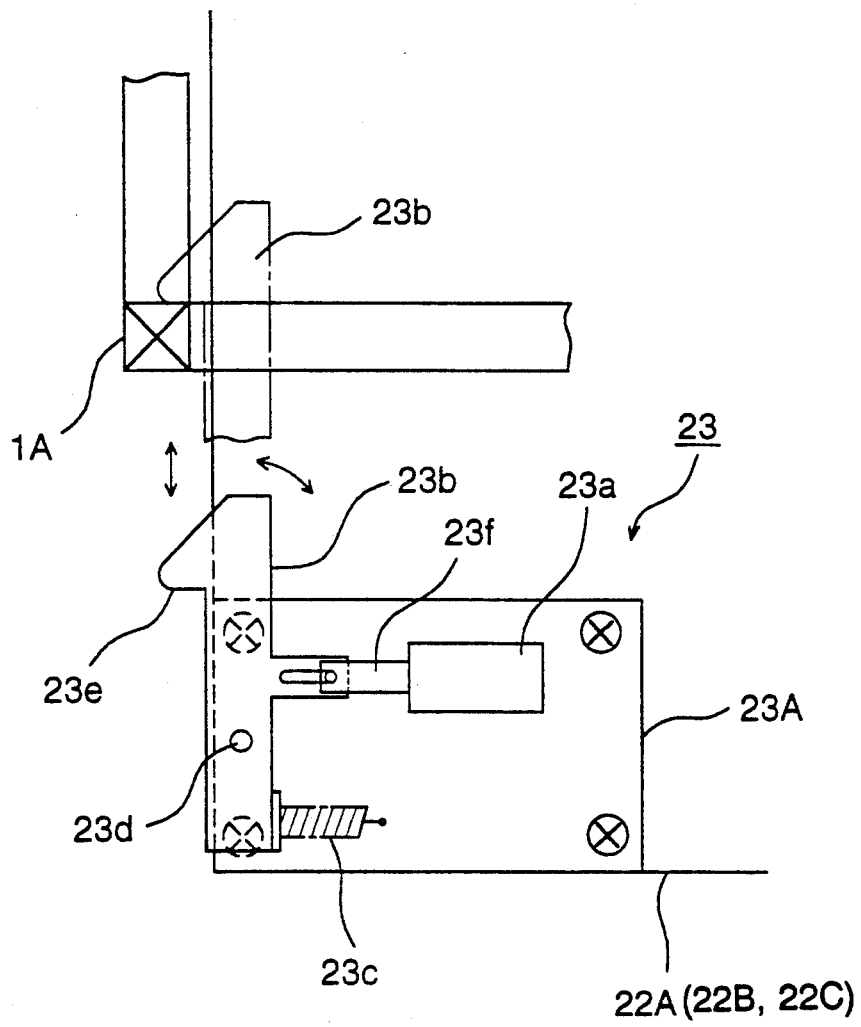
FIG. 3 is an upper view showing an engagement means.
Figure 4:
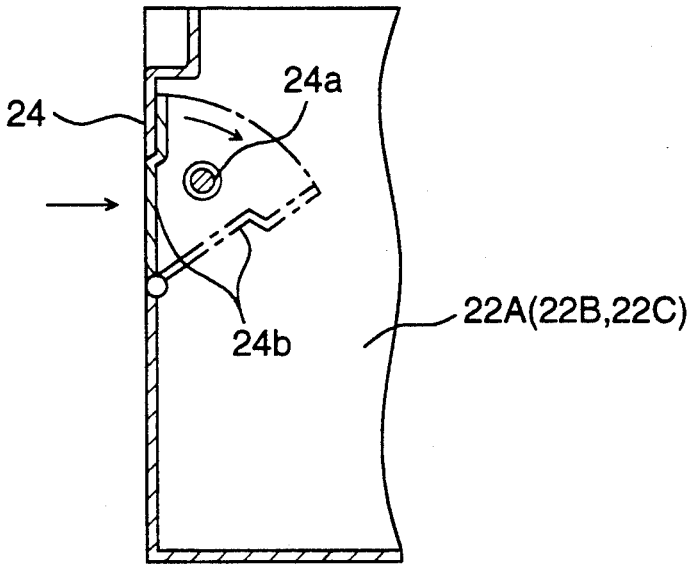
FIG. 4 is a schematic illustration showing a detection means of a handle section.
Figure 5:
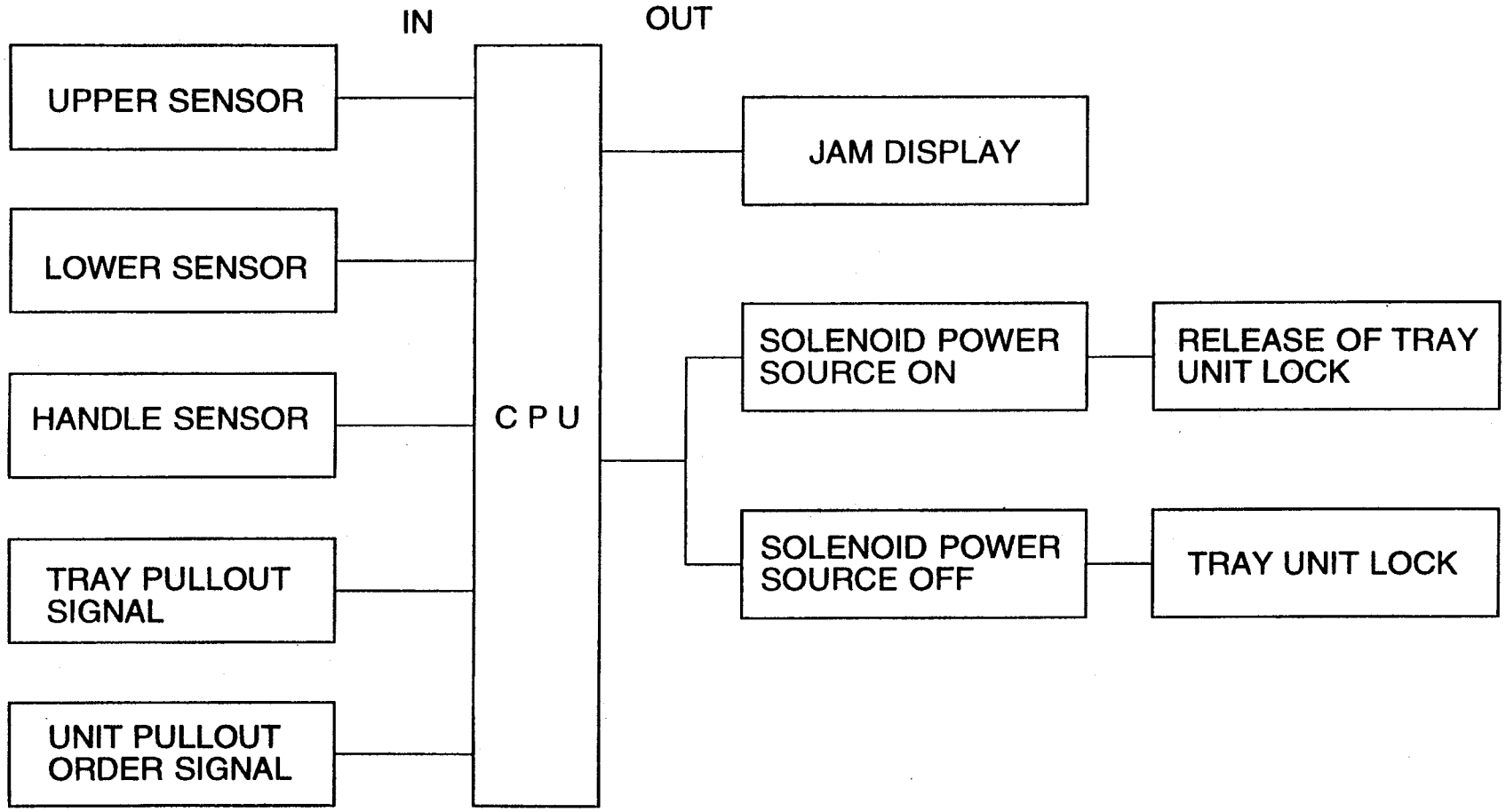
FIG. 5 is a block diagram showing a controlling operation of lock and unlock of a paper feed tray unit according to the first example of the present invention.
Figure 6:
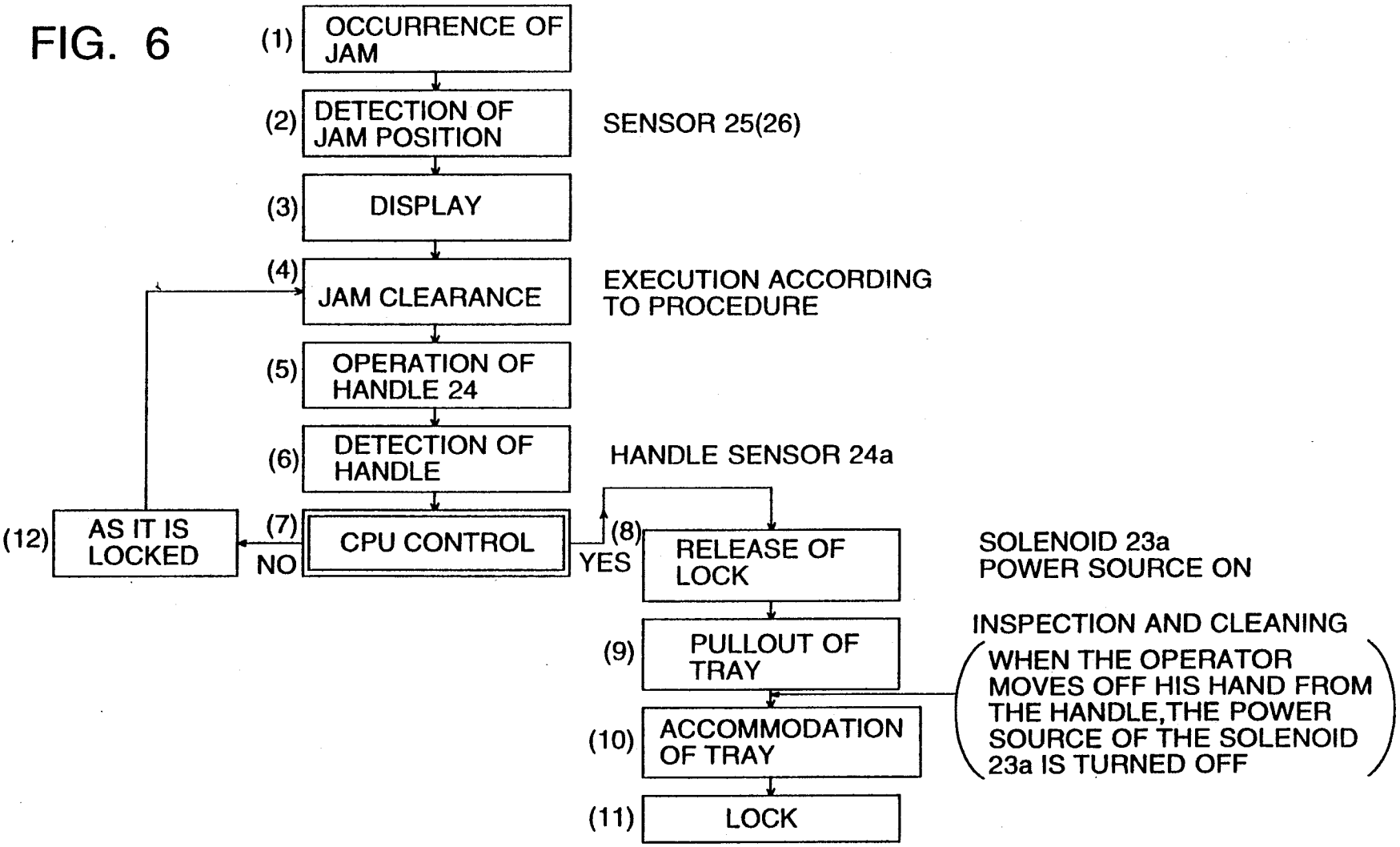
FIG. 6 is a flow chart showing a jam clearance procedure according to the first example of the present invention.
Figure 7:
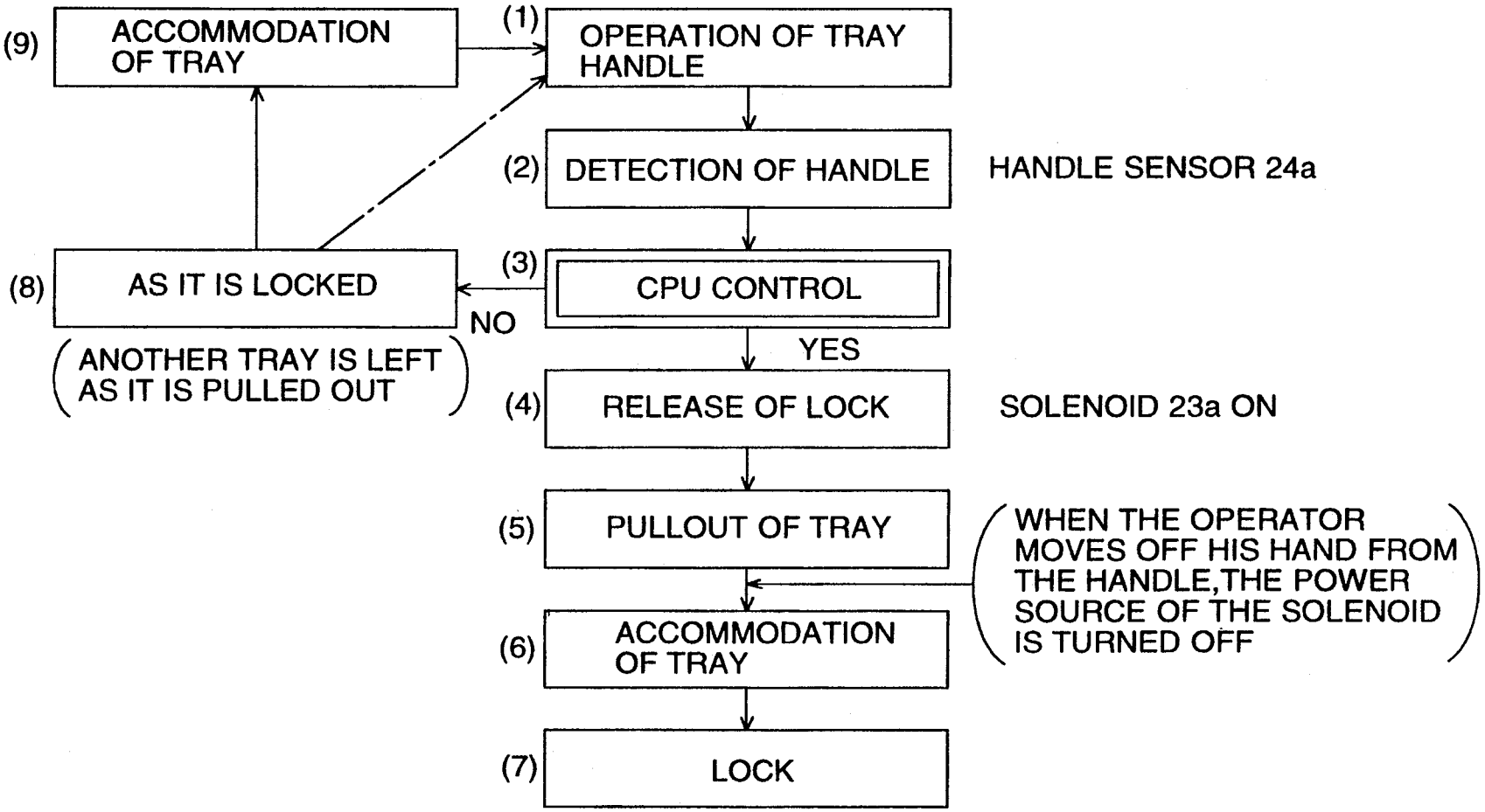
FIG. 7 is a flow chart showing a method to pull out a paper feed tray unit and also showing a procedure of pullout according to the first example of the present invention.

The first example of the present invention will be explained with reference to FIGS. 1 to 7, wherein FIG. 1 is a sectional side view showing the structure of an image forming apparatus, FIG. 2 is a sectional side view showing the structure of a paper feed tray unit and a conveyance section, FIG. 3 is an upper view showing an engagement means, FIG. 4 is a schematic illustration showing a detection means of a handle section, FIG. 5 is a block diagram showing a controlling operation of lock and unlock of a paper feed tray unit, FIG. 6 is a flow chart showing a jam clearance procedure, and FIG. 7 is a flow chart showing a method to pull out a paper feed tray unit and also showing a procedure of pullout.

However, it is to be understood that the present invention is not limited to the specific example.

As shown in FIG. 1, a platen glass P on which a document M is placed is provided on the upper surface of a main body 1 of an electrophotographic image forming apparatus 18, and an optical scanning system 2 is provided under the platen glass P. The optical scanning system 2 includes a reciprocating document illuminating lamp 2*a*, a first mirror 2*b*, second and third mirrors 2*c* forming a V-shape, a fixed lens 2*d*, and a fourth mirror 2*e*. A photoreceptor drum 3 is provided in the center of the main body 1, wherein the photoreceptor drum 3 can be rotated in the arrowed direction. Around the photoreceptor drum 3, there are sequentially provided a charging electrode 4 to uniformly charge the photoreceptor surface 3*a*, development unit 6 having a development sleeve 6*a*, toner being supplied to the development unit 6 by a toner hopper 5, electrode 7, separation electrode 8, discharge electrode 9, and cleaning unit 10. On the left in the lower portion of the main body 1, there are provided a first paper feed tray unit 22A, second paper feed tray unit 22B located below the first paper feed tray unit, and third paper feed tray unit 22C located on the right of the first and second paper feed tray units 22A and 22B. Three types of recording papers 30, the sizes of which are different, are accommodated in the above paper feed tray units. The first, second and third paper feed tray units will be referred to as the first, second and third paper feed trays, hereinafter. Numeral 12 is a first paper feed roller pin that conveys a recording paper 30 accommodated in the first paper feed tray 22A to a waiting position before a second paper feed roller pair 13. Numeral 13 is the second paper feed roller that temporarily stops the recording paper 30 conveyed by the first paper feed roller pair 12, and feeds the recording paper 30 again in an appropriate timed relation so that the end of a visual image on the photoreceptor surface 3*a* can coincide with the end of the recording paper 30. Numeral 14 is a guide plate that guides the recording paper 30 from the first paper feed roller pair 12 to the second paper feed roller pair 13. Numeral 15 is a conveyance unit that conveys the recording paper 30 onto which an image has been transferred, to a fixing position. Numeral 16 is a fixing unit composed of a heat roller 16*a* and a press roller 16*b*. Numeral 17 is a paper discharge roller that discharges the recording paper 30 outside after transfer.

As shown in FIG. 2, the recording papers 30 accommodated in the first, second and third paper feed trays 22A, 22B and 22C are conveyed to the second paper feed roller pair 13 through the first paper feed roller pair 12 and the guide plate 14 by a vertical conveyance section 11 provided on the left side surface of the image forming apparatus 18, wherein the vertical conveyance section 11 is used as a common paper conveyance passage in this apparatus. In the vertical conveyance section 11, there are provided a pair of lower rollers 11*a* that convey the recording papers 30 sent out from the second paper feed tray 22B, a vertical guide plate 11*b*, and a pair of upper rollers 11*c* that convey the recording papers 30 sent out from each of the first and third paper feed trays 22A, 22C. The left roller of the lower rollers 11*a* the vertical guide plate 11*b*, and the left roller of the upper rollers 11*c* are integrally attached onto the side plate 11A of the vertical conveyance section 11, and the side plate 11A is pivotally supported by a shaft 11*d* provided downward. Accordingly, when the side plate 11A is opened, the pairs 11*a*, 11*c* of upper and lower rollers are separated from each other. In the vertical conveyance section 11, there are provided an upper sensor 25 to detect the conveyance condition of the recording papers 30 sent from the first and third paper feed trays 22A, 22C, and a lower sensor 26 to detect the recording papers 30 sent from the second paper feed tray 22B.

As shown in FIG. 1, the first paper feed roller pair 12, second paper feed roller pair 13, guide plate 14, transfer electrode 7, separation electrode 8, and conveyance unit 15 are integrated into one unit so as to form a paper feed conveyance unit 20. In FIG. 1, the paper feed conveyance unit 20 can be pulled out to the viewer's side (in the direction perpendicular to the surface of the drawing) by the paper feed conveyance unit rails 20*a* provided on both lower sides of the paper feed conveyance unit 20 and also provided on frames (not shown) of the main body 1. Also, the fixing unit 16 and the paper discharge roller 17 are integrated into one unit as a fixing unit 21. This integrated fixing unit can be also pulled out to the viewer's side by the integrated fixing unit rails 21*a* provided on both lower sides of the fixing unit 21 and also provided on the frames of the main body 1.

Common paper feed rails 22*a* are provided to each of the first, second and third paper feed trays 22*a*, 22*b*, 22C, and also the rails 22*a* of the same size are provided on the frames of the main body 1, so that each paper feed tray can be independently pulled out to the viewer's side.

Members that are common in size and function may be used for the rails 20*a*, 21*a*, 22*a*. The vertical conveyance section 11, paper feed conveyance unit 20 and fixing unit 21 form a conveyance passage for the recording papers 30 sent out from the first, second and third paper feed trays 22A, 22B, 22C.

When a copy button is pressed in the above apparatus 18, the document M on the platen glass P is exposure-scanned by the optical scanning system 2, and an electrostatic latent image of the document M is formed on the photoreceptor surface 3*a* of the photoreceptor drum 3. This electrostatic latent image is developed by the development unit 6 so that it is changed into a visual image. This visual image is transferred onto a recording paper 30 sent from one of the paper feed tray units 22A, 22B, 22C, by the action of the transfer electrode 7. After the transfer operation has been completed, the recording paper 30 is separated from the photoreceptor surface 3*a* by the separation electrode 8, and conveyed to the fixing unit 16 by the conveyance unit 15. The image is fixed onto the recording paper 30 by the fixing unit 30, and then the recording paper 30 is discharged by the paper discharge roller 17. In the manner described above, predetermined toner images are successively recorded on the surfaces of the recording papers 30.

While the first, second and third paper feed trays 22A, 22B, 22C are taken for example, a jam clearance job to clear a jammed paper bestriding two units, and a method to pull out units will be explained as follows.

As shown in FIG. 3, the first, second and third paper feed trays 22A, 22B, 22C, which can be pulled out from the image forming apparatus 18, are provided with an engagement unit 23 that is an engagement means, and a handle 24 to pull out the engagement unit 23.

When the first, second and third paper feed trays 22A, 22B, 22C are accommodated in predetermined positions in the image forming apparatus 18, they are always locked in the main frame 1A by the engagement units 23 so that they can not be carelessly pulled out. For example, the engagement unit 23 attached to the first paper feed tray 22A includes: a solenoid 23*a* mounted on a base plate 23A; an engagement plate 23*b* pivotally provided around a shaft 23*d* on the left of the solenoid 23*a;* and a spring 23*c,* one end of which is hooked at the base plate 23A and the other end of which is hooked at the lower portion of the engagement plate 23*b* so that the engagement plate 23*b* is pushed counter-clockwise. The engagement unit 23 is mounted at a predetermined position of the first paper feed tray 22A through the base plate 23A. When the paper feed tray 22A is pushed and accommodated into the main body 1, at the last stage of the accommodation process, the engagement plate 23*b* is locked to the main frame 1A in such a manner that the engagement plate 23*b* once gets over the frame resisting the force of the spring 23*c* and returns to the initial position so that it is locked to the main frame. As a result, the first paper feed tray 22A can not be pulled out from the image forming apparatus 18.

When the power supply is turned on and the solenoid 23*a* is excited, a solenoid plunger 23*f* that engages with the engagement plate 23*b* through a pin is pulled to the right, so that the engagement plate 23*b* is rotated clockwise, resisting the force of the spring 23*c,* and a claw portion 23*e* of the engagement plate 23*b* is separated from the main frame 1A. As a result, the engagement plate 23*b* is released Also, the second and third paper feed trays 22B, 22C are provided with the same engagement unit 23.

Accordingly, when the first, second and third paper trays 22A, 22B, 22C are respectively accommodated in the predetermined positions, they are always in a locked condition. As shown in FIG. 4, the handles of the first, second and third paper trays 22A, 22B, 22C are provided with a handle sensor 24*a* which is a transmission type photosensor. When an operator touches the handle 24, a handle cover 24*b* is pushed clockwise, so that the operator's hand can be detected by the sensor. Under the condition that no problems are caused, only one of the paper feed trays 22A, 22B, 22C can be pulled out from the apparatus according to the detection signals sent from the handle sensors 24*a.* The paper feed trays are constructed in such a manner a paper feed tray in a paper feeding operation can not be pulled out.

While the handle sensor 24*a* is detecting the operator's hand, the solenoid 23*a* is turned on by the control of the CPU, so that the paper feed tray is released from the engagement plate 23*b,* and when the operator lets go of the handle 24, the solenoid 23*a* is turned off, and the paper feed tray is locked by the engagement plate 23*b.* For example, when the first paper feed tray 22A is pushed into the apparatus by the operator after the recording papers 30 have been supplied to it, the engagement plate 23*b* is activated, so that the first paper feed tray 22A is automatically locked.

As shown in FIG. 2, in the case where a recording paper 30 is jammed between the second paper feed tray 22B and the lower roller 11*a* of the vertical conveyance section 11 while the recording paper 30 is bestriding both units, the lower sensor 26 detects the jammed position, and the occurrence of jam is displayed on a display section (not shown) of the image forming apparatus 18. According to the display of jam occurrence, the operator opens the vertical conveyance section 11 in accordance with the normal procedure, and removes the jammed recording paper 30. After that, when the operator touches the handle 24 in order to inspect the second paper feed tray 22B, the operator's hand is detected by the handle sensor 24*a.* Only in the case where the jammed paper has already been removed and there are no problems in other units (for example, other paper feed units are not pulled out), the CPU controls to turn off the solenoid 23*a,* so that the second paper feed tray 22B is released and pulled out from the apparatus. As described before, when the operator lets go of the handle 24, the solenoid 23*a* is turned off and the engagement plate 23*b* returns to the lock position. Consequently, when the regular procedure is not followed, that is, when the handle 24 of the second paper feed tray 22B, in which a recording paper is jammed, is operated to pull out the second paper feed tray 22B without opening the vertical conveyance section 11, the solenoid 23*a* is turned off by the control of the CPU by which the operation has previously been stored, so that the second paper feed tray 22B is in a locked condition. Accordingly, the second paper feed tray 22B can not be pulled out.

In the same manner as the second paper feed tray 22B, the first and third paper feed trays 22A, 22C are locked and released by the engagement plate 23*b* when the solenoid 23*a* is turned on and off.

Only one of the first, second and third paper feed trays 22A, 22B, 22C can be pulled out, and after a paper feed tray pulled out has been accommodated in a predetermined position, the next required paper feed tray can be pulled out. When necessary, the spirit of the present invention is applied to the paper feed conveyance unit 20 and the fixing unit 21. Accordingly, the image forming apparatus 18 of the present invention does not lose the balance when a plurality of paper feed trays and other units are carelessly pulled out. Therefore, collapse of the apparatus can be prevented.

In order to make the image forming apparatus 18 more compact, for example, the photoreceptor drum unit and the paper feed conveyance unit 20 and also other mechanism units are overlapped with each other. In this case, the order to pull out each unit is previously determined. For example, unless the paper feed conveyance unit 20 is pulled out, the photoreceptor drum unit can not be pulled out.

Therefore, when an attempt is made to pull out a unit in wrong order, the unit is in a locked condition, so that it can not be pulled out. In the case of jam clearance, or in the case where one designated paper feed tray is pulled out, or in the case where the pullout order is specified, the first, second and third paper feed trays 22A, 22B, 22C and other mechanism units are locked and released in accordance with the control of the CPU shown in FIG. 5, wherein necessary data has previously been stored in the CPU.

In the case where a recording paper is jammed between the paper feed conveyance unit 20 and the fixing unit 21 while the jammed paper is bestriding both units, the jammed paper is detected by a sensor (not shown). Then, the plunger of a solenoid (not shown) is activated, and the units 20, 21 are connected. Accordingly, when the paper feed conveyance unit 20 is pulled out, the fixing unit 21 can be concurrently pulled out.

Therefore, the jammed recording paper 30 can be removed from the upside of the paper feed conveyance unit 20 that has been pulled out, and the upper portion of which has already been opened.

With reference to the flow chart shown in FIG. 6, the procedure of jam clearance will be explained as follows in the case where a recording paper has been jammed between the second paper feed tray 22B and the vertical conveyance section 11 of each of the first, second and third paper feed trays 22A, 22B, 22C while the jammed recording paper is bestriding both units.

As shown in the flow chart of FIG. 6, when a recording paper is jammed (step 1), the image forming apparatus 18 is stopped. For example, the recording paper jammed between the second paper feed tray 22B and the lower roller 11*a* is detected by the lower sensor 26 (step 2), and the condition of jam is displayed on the panel of the image forming apparatus 18 (step 3). Then, the operator opens the vertical conveyance section 11, which is the right jam clearance procedure (4), and the jammed recording paper 30 is removed from the apparatus. The removal of the jammed recording paper 30 is fed back to the CPU. For inspection and cleaning, the operator holds the handle 24 of the second paper feed tray 22B (step 5), so that the handle sensor 24*a* detects the operator's hand (step 6). Then, the information of the handle sensor 24*a* is inputted into the CPU (step 7). At this time, the CPU collectively judges whether or not the jammed recording paper has already been removed, and whether or not each of the first and third paper feed trays 22A, 22C has been pulled out. In the case where there are no problems, it is judged to be YES, and the solenoid 23*a* of the engagement unit 23 is turned off (step 8) so that the engagement plate 23*b* is released from the main frame 1A.

Consequently, it is confirmed in step 9 that the second paper feed tray 22B has been pulled out and the jammed recording paper 30 has been positively removed. At the same time, the apparatus is cleaned to remove dust and foreign objects so that the successive recording paper 30 can be conveyed in a right condition. After, the inspection and cleaning of the vertical conveyance section 11 and the second paper feed tray 22B has been completed, the vertical conveyance section 11 and the second paper feed tray 22B are accommodated to the predetermined positions (step 10). The second paper feed tray 22B is locked again (step 11). In the case where it has been judged to be NO in the control process of the CPU in step 7, the second paper feed tray 22B is left as it is locked (step 12). Accordingly, the program returns to step 4, and the operator opens the vertical conveyance section 11 in accordance with the right procedure (step 4) in order to check, and then step 5 and after that are repeated.

Next, with reference to the flow chart shown in FIG. 7, will be explained the procedure by which only one of the first, second and third paper feed trays 22A, 22*b*, 22C can be pulled out. In this connection, the lock and release mechanism composed of the engagement unit 23 is the same as described above.

As shown in FIG. 7, when the handle 24 of the second paper feed tray 22B is operated (step 1), the operator's hand is detected by the handle detection sensor 24*a* (step 2), and the detected information of the handle sensor 24*a* is inputted into the CPU (step 3). Then, the CPU judges whether or not the first and third paper feed trays 22A, 22C have been pulled out, and whether or not jam has occurred in other units. In the case where the result of judgment is YES, the solenoid 23*a* is turned off and the engagement plate 23*b* is released from the main frame IA (step 4). After that, the second paper feed tray 22B is pulled out (step 5), and, for example, the recording papers 30 are supplied to the tray. After the second paper feed tray 22B has been accommodated in the image forming apparatus 18 (step 6), it is automatically locked in the same manner as described before (step 7).

In the case where another paper feed tray has already been pulled out, it is judged to be NO by the control of CPU (step 3), and the engagement unit 23 is left as it is locked (step 8).

Accordingly, after the operator has accommodated another tray that was pulled out, in a predetermined position (step 9), the program returns to step 1, and the required second paper feed tray 22B is pulled out. When the CPU is inputted with various information in the manner described above such as circumstances of the paper feed trays 22A, 22B, 22C, and other information if necessary, only one paper feed tray is pulled out by the control of the CPU. Accordingly, a plurality of paper feed trays are not carelessly pulled out. Therefore, it can be prevented to lose the balance of the image forming apparatus 18, and the image forming apparatus 18 can be prevented from collapsing.

In the case where the order of pulling out the mechanism units composing the image forming apparatus 18 is designated, the operation can be performed in accordance with the same procedure as that shown in FIG. 7. That is, when it is attempted to pull out a unit in wrong order, the CPU judges to be NO in accordance with the previously inputted information, so that the solenoid of the engagement unit 23 provided in each unit is turned off and the unit can not be pulled out. Therefore, the program returns from step 8 (lock) to step 1 (tray handle operation), and the mechanism unit is pulled out in accordance with the right order.

Accordingly, since the mechanism units are pulled out in right order, the photoreceptor drum and the mechanism units are not damaged.

Next, the second example of the connection mechanism of the present invention will be explained as follows, by which two units are automatically connected when a recording paper is jammed between the two units while the jammed paper is bestriding both units.

Figure 8:
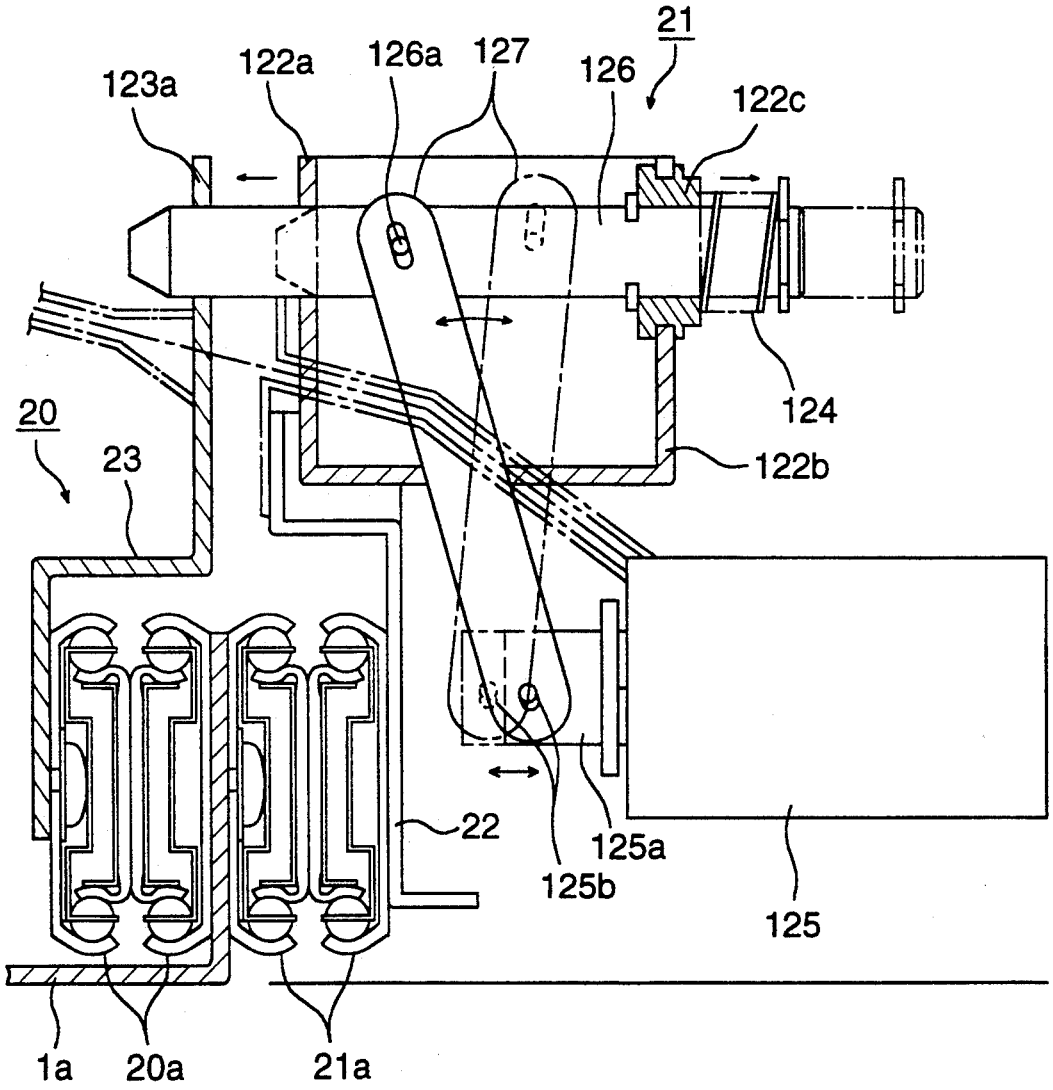
FIG. 8 is a sectional side view showing the structure of a connection mechanism according to the second example of the present invention.

The second example is illustrated in FIG. 8 in which the right and left end portions of the image forming apparatus are omitted here. As shown in FIG. 8, A-rail 20*a* is provided in the lower portion of the right side of the paper feed unit case forming the housing of the paper feed conveyance unit 20. B-rail 21*a* is provided in the lower portion of the fixing unit case 22 of the fixing unit 21: Between the A and B rails 20*a*, 21*a*, the main frame 1*a* is provided, and on both sides of the main frame 1*a*, the same A and B rails 20*a*, 21*a* are provided. Accordingly, the paper feed conveyance unit 20 and the fixing unit 21 can be pulled out to the operator's side (in the direction perpendicular to the surface of the drawing) through the A and B rails 20*a*, 21*a*.

In the upper portion of the fixing unit case 22, a bracket composed of front and rear plates 122*a*, 122*b* is integrally provided.

A connecting rod 126 is slidably engaged with a hole formed on the front plate 122*a* and a hole formed in a bearing 122*c* of the rear plate 122*b*. A spring 124 is provided in the rear end portion of the connecting rod 126, whereby the left end of the spring 124 comes into contact with the right side of the bearing 122c, and the right end of the spring 124 comes into contact with a flange integrally formed on the connecting rod 126. Accordingly, the connecting rod 126 is always pushed to the right by the resilience of the spring 124, and the rear end of the connecting rod 126 is positioned at a predetermined position shown by a chain line.

The connecting rod 126 is made of steel and has rigidity. For example, the connecting rod 126 is a cylindrical rod of which the diameter is approximately 10 mm. When the connecting rod 126 is positioned being pushed to the right by the spring 124, the left end portion of the connecting rod 126 protrudes a little from the surface of the front plate 122a as shown by a chain line in the drawing, so that a predetermined gap is formed between the left end of the connecting rod 126 and the connecting hole 123a of the paper feed unit case, that is, the left end of the connecting rod 126 is opposed to the connecting hole 123a.

As shown in the drawing, a solenoid 125 is provided in the lower portion of the connecting rod 126, and mounted at a predetermined portion of the fixing unit case 22. The connecting rod 126 and the solenoid 125 are connected by a connecting plate 127. In this case, the connecting plate 127 is connected with a plunger 125a of the solenoid 125 through a connecting pin 125b implanted in the plunger 125a and through a long hole formed in the connecting plate 127, and also the connecting plate 127 is connected with the connecting rod 126 through a connecting pin 126a implanted in the connecting rod 126 and also through a long hole formed in the connecting plate 127.

When recording papers are properly conveyed, the plunger 125a is in a protruding position shown by a chain line, and at this time the connecting plate 127 is located in a position shown by a chain line.

The solenoid 125 is a latching type solenoid. For example, when the solenoid 125 is excited by the control of the CPU, the plunger 125a is withdrawn by a predetermined distance, and the plunger 125a is held in that position. In order to return the plunger 125a to the initial position, the solenoid 125 is turned on by the control of the CPU in accordance with a predetermined signal, and the plunger 125a is returned to the protruding position by the resilience of the spring 124. For example, in the case where a recording paper is jammed between the paper feed conveyance unit 20 and the fixing unit 21 bestriding both units, the jammed paper is detected by a transmission type photosensor of the prior art provided in an appropriate position in the paper feed conveyance unit 20, and the solenoid 125 is turned on by the control of the CPU in accordance with the detection signal fed back to the CPU (not shown) in the image forming apparatus 18 illustrated in FIG. 1. When the solenoid 25 is turned on, the plunger 125a is withdrawn resisting the resilience of the spring 124.

When the plunger 125a is withdrawn by a predetermined distance as shown by a solid line, the connecting plate 127 is rotated counterclockwise in the arrowed direction through the connecting pin 125b. At the same time, the connecting rod 126 is protruded by a predetermined distance to the left in the arrowed direction through the connecting pin 126a, so that the connecting rod 126 enters the connecting hole 123a of the paper feed unit case 123. In this way, the paper feed conveyance unit 20 and the fixing unit 21 are automatically connected.

When the occurrence of a jam is displayed on a display panel (not shown) in the image forming apparatus 18, the operator opens the front door and pulls out the paper feed conveyance unit 20 to the operator's side, so that the fixing unit 21 connected with the paper feed conveyance unit 20 is concurrently pulled out. After the units 20, 21 have been pulled out by a predetermined distance, the jammed recording paper is removed from the open conveyance belt surface. Then, the paper feed conveyance unit 20 and the fixing unit 21 are returned to the initial positions in the image forming apparatus 18. When the paper feed conveyance unit 20 and the fixing unit 21 have been returned to the initial positions, signals are sent out by sensors provided close to the positions. In accordance with the signals, the CPU controls the solenoid 125 so that the solenoid 125 is turned on, and the plunger 125a becomes free. Therefore, the connecting rod 126 is disengaged from the connecting rod 123a by the resilience of the spring 124, so that the units 20 and 21 are disconnected from each other. At the same time, the plunger 125a returns to the protruding position through the connecting plate 127.

The second example of the present invention is constructed in the manner described above. Therefore, even when a recording paper is jammed between the paper feed conveyance unit 20 and fixing unit 21 bestriding both units, the operator can easily remove the jammed recording paper without damaging it.

In the above descriptions of the present invention, the monochromatic image forming apparatus 18 is taken for example, however, it should be understood that the present invention can be applied to a color image forming apparatus.

In the above description, the present invention is applied to the image forming apparatus 18 in which each paper feed tray is accommodated. However, the present invention can be applied to a case in which a plurality of optional paper feed trays are connected to the image forming apparatus 18.

According to the present invention, even when a recording paper is jammed, for example, between the second paper feed tray and the vertical conveyance section, bestriding the two units, the operator can quickly and positively remove the jammed recording paper. Also, the apparatus is controlled so that only one paper feed tray can be pulled out. Therefore, the apparatus can be always well-balanced, and collapse of the apparatus can be avoided. In the case of jam clearance, the units composing the apparatus are pulled out in a predetermined order. Accordingly, the image forming apparatus can be constructed compact, and the units are not damaged with each other.

What is claimed is:

1. An image forming apparatus for forming an image on a recording paper, comprising:

a paper feed tray for holding said recording paper;

means, having a first unit body, for conveying said recording paper from said paper feed tray;

means for forming a toner image onto said recording paper;

means, having a second unit body, for fixing said toner image on said recording paper;

means for detecting a paper jam between said first unit body and said second unit body, and for generating a detection signal;

means for locking said first unit body and said second unit body;

means for controlling said locking means according to said detection signal so that said first unit body and said second unit body are resisted from being removed separately when said paper jam occurs between said first unit body and said second unit body.

2. The apparatus of claim 1, wherein said locking means includes:

means for coupling each of said first unit body and said second unit body onto a main body frame of said apparatus.

3. The apparatus of claim 1, wherein said locking means includes:

means for coupling said first unit body onto said second unit body.

4. The apparatus of claim 1, wherein said controlling means controls said locking means to release said first unit body and said second unit body when said paper jam is removed so that said first unit body and said second unit body are removable separately.

5. An image forming apparatus for forming an image on a recording paper, comprising:

a plurality of paper feed tray units for holding said recording paper;

means, having a first unit body, for conveying said recording paper from one of said paper feed tray units;

means for forming a toner image onto said recording paper;

means, having a second unit body, for fixing said toner image on said recording paper;

means for detecting a paper jam between at least two of said paper feed tray units, said first unit body, and said second unit body, and for generating a detection signal;

means for locking said paper feed tray units, said first unit body, and said second unit body;

means for controlling said locking means according to said detection signal so that said paper feed tray un said first unit body, and said second unit body are resisted from being removed separately when said paper jam occurs between at least two of said paper feed tray units, said first unit body, and said second unit body.

6. The apparatus of claim 5, where in said locking means includes:

means for coupling each of said paper feed tray units, said first unit body, and said second unit body onto a main body frame of said apparatus.

7. The apparatus of claim 5, wherein said controlling means controls said locking means to release said paper feed tray units, said first unit body, and said second unit body when said paper jam, between at least two of said paper feed tray units, said first unit body, and said second unit body, is removed so that each of said paper feed tray units, said first unit body, and said second unit body is respectively removable separately.

8. The apparatus of claim 7, wherein said controlling means controls said locking means to release said paper feed tray units, said first unit body, and said second unit body in a predetermined order.

9. The apparatus of claim 7, wherein said controlling means controls said locking means to release one of said paper feed tray units, said first unit body, and said second unit body, and other ones of said paper feed tray units, said first unit body, and said second unit body are resisted from being removed.

* * * * *